United States Patent [19]

Berzin

[11] Patent Number: 4,838,349

[45] Date of Patent: Jun. 13, 1989

[54] APPARATUS FOR TESTING SELECTED ZONES OF A SUBTERRANEAN BORE

[75] Inventor: Vel Berzin, Houston, Tex.

[73] Assignee: Baker Oil Tools, Inc., Orange, Calif.

[21] Appl. No.: 79,703

[22] Filed: Nov. 16, 1987

[51] Int. Cl.[4] ..... E21B 33/127

[52] U.S. Cl. ..... 166/187; 166/250; 166/323

[58] Field of Search ..... 166/250, 66, 187, 321, 166/323, 242

[56] References Cited

U.S. PATENT DOCUMENTS 4,345,648 8/1982 Kuus ..... 166/187 X 4,366,862 1/1983 Brandell ..... 166/187 X

*Primary Examiner*—William P. Neuder

*Attorney, Agent, or Firm*—Hubbard, Thurman, Turner & Tucker

[57] ABSTRACT

Apparatus for testing a selected zone of a subterranean bore, which may comprise a subterranean uncased well bore, comprises a pair of inflatable packers mounted in spaced relationship on a tubular outer housing to define the axial extent of the selected zone to be tested. Fluid pressure passages for inflating the packers, for monitoring the fluid pressure between the inflated packers, and above and below the inflated packers, are defined by a plurality of peripherally spaced passages formed in a multi-section tubular conduit. The fluid passages in each conduit section do not extend axially beyond the ends of the particular section but communicate with peripherally spaced radial ports. These ports in turn communicate with similar peripherally spaced, radial ports provided in the next adjacent conduit section so that the flow of fluid through the various passages is axially through the length of the section, radially outwardly into the end of the next section, and radially inwardly into the end of the next subsequent section. The disposition of the forementioned fluid passages in the walls of the conduit section permits the central bore of the conduit to be employed to mount transducers for respectively converting fluid pressure signals into electrical signals.

14 Claims, 13 Drawing Sheets

APPARATUS FOR TESTING SELECTED ZONES OF A SUBTERRANEAN BORE

BACKGROUND OF THE INVENTION

1. Field of the Invention

The present invention relates to an apparatus for effecting the pressure or vacuum testing of selected zones of a subterranean bore, such as an uncased well bore.

2. History of the Prior Art

In recent years, there has been considerable interest developed in the utilization of subterranean well bores for the storage of nuclear waste materials. If such highly dangerous materials are to be deposited in a well bore, there must be reasonable assurance that the nuclear waste materials will not migrate from the deposited zone in the well bore due to the porosity of the formation in that zone. There should also be reasonable assurance that fluids in the selected formation will not seep out of the well bore and cause a dispersion of the nuclear waste material from the selected subterranean deposit zone.

A method and apparatus for conducting the testing of a selected zone of an uncased subterranean well bore is disclosed in co-pending application Ser. No.: 859,441 filed 5/5/86, and assigned to the Assignee of the instant invention. In the meantime, it has been realized that the hydrological testing should not be limited to subterranean well bores but could well be applied to horizontal or evenly upwardly directed passages which are initiated from a lower level of a mine shaft. It is therefore desirable that suitable apparatus be provided which may be employed in any form of subterranean bore, so long as the bore is reasonably cylindrical in configuration.

One of the problems encountered in designing such hydrological survey apparatus is the necessity for many fluid passages required to make an effective hydrological survey of a subterranean bore. A pair of axially spaced inflatable packers still constitutes the most efficient apparatus for effecting the isolation of a selected zone of the subterranean bore. To inflate such packers and then concurrently monitor the fluid pressures existing between the inflatable packers and in the zones immediately above and below the inflatable packers requires a plurality of separate fluid conduits which, as a practical matter, cannot be effectively mounted on the exterior of a tubing string employed to insert the inflatable packers into the subterranean bore. When an attempt is made to dispose the various fluid passages within the central bore of the tubing string, the apparatus becomes unnecessarily complex as illustrated by the apparatus disclosed in the above referred to co-pending application. Furthermore, the bore of the apparatus is completely filled with fluid passages and pressure transducers so that if it is desired to utilize the same apparatus for supplying a large quantity of treatment fluid to the isolated zone between the two packers, the entire hydrological testing apparatus has to be removed and a new fluid treatment apparatus inserted in its place. There is a need, therefore, for an improved hydrological testing apparatus which will efficiently provide the plurality of fluid passages required for the operation of the inflatable packers and the monitoring of the various zones determined by the inflation of the packers, and which may be readily converted to a fluid treatment apparatus.

SUMMARY OF THE INVENTION

This invention provides a hydrological survey apparatus incorporating a pair of axially spaced packers to isolate a selected zone in a well bore, characterized by the fact that each of the interconnected tubular components of the apparatus carries within the outer wall of each tubular section of the apparatus a plurality of axially extending passages, and two sets of peripherally spaced radial ports communicating respectively with the opposite ends of the axially extending passages. The next adjacent section of the apparatus, containing similar peripherally spaced axially extending conduits in its wall is threadably secured to the first mentioned section in telescopic relationship thereto and is provided with a plurality of radially and peripherally spaced ports providing communication between the radial ports in the first mentioned section and the axially extending fluid passages in the section mentioned section. Thus, a plurality of fluid passages may be accommodated within the walls of the tubular sections making up the hydrological survey apparatus.

If it is desired that the fluid passages utilized for monitoring fluid pressures in the selected zone between the inflated packers and the zones respectively above and below such packers, the central bore of one tubular section of the hydrological apparatus may be utilized to mount three sealably isolated fluid pressure transducers which are respectively connected to the fluid passages communicating with the selected zone between the packers and between the zones immediately above and below the inflated packers. Thus the fluid pressure signals generated in such zones are converted into electrical signals which are conveyed by a cable which extends through a suitable aperture in the wall of the particular section and runs in a slot along the exterior of the interconnected conduit sections to the entry point of the earth bore.

A further feature of the invention is the provision of a fill-up valve at the bore entering end of the apparatus. In the event that the bore into which the apparatus is to be inserted is filled or partially filled with fluid, it is desirable to provide an opening in the bottom of the apparatus to permit such fluid to flow freely upwardly through the apparatus. To accomplish this, a fluid pressure actuated valve is incorporated in the bottom end of the apparatus which valve is normally in an open position but, by applying fluid pressure can be shifted to a closed position preventing further inlet of the well fluid after the apparatus is located at its desired position in the well bore. Still another feature of the invention is the utilization of fluid pressure to effect both the setting and unsetting of the inflatable packer elements, thus eliminating any need for manipulation of the tubing string which has been a characteristic of prior art apparatus and represents a substantial problem when the bore deviates from a straight line.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 6A:
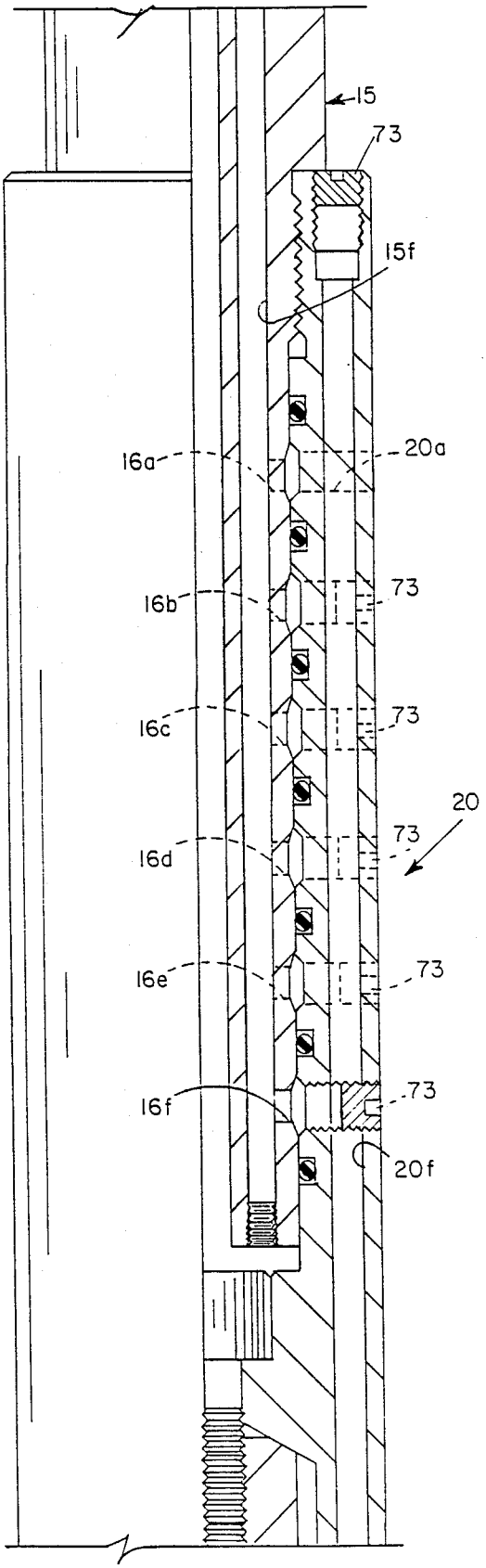
FIGS. 6A, 6B, 6C, 6D, 6E and 6F collectively constitute an enlarged scale, vertical quarter-sectional view illustrating the portion of the apparatus of FIGS. 1A–1D housing the electrical transducers utilized to convert fluid pressure signals into electrical signals, and a lower coupling sleeve.
Figure 6B:
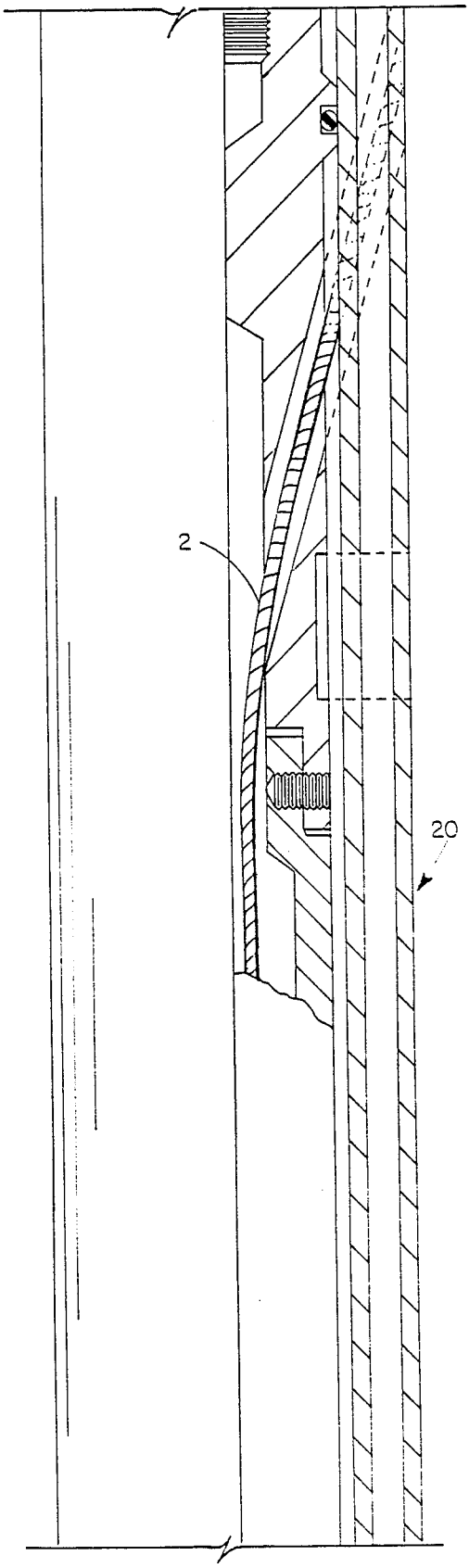
Figure 6C:
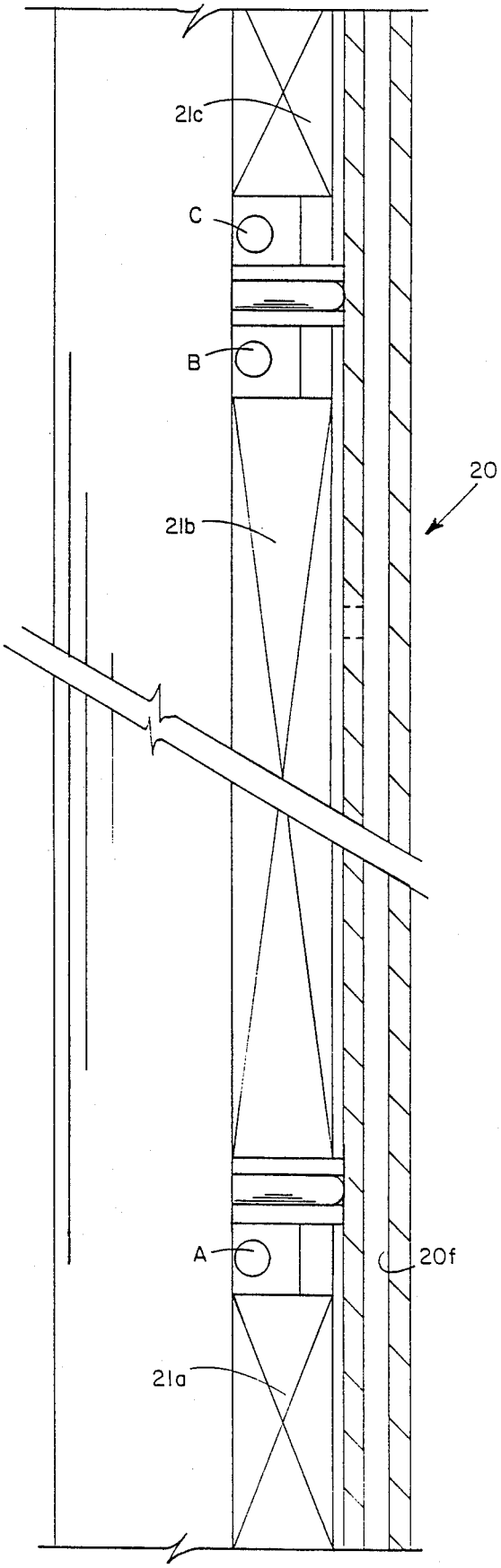
Figure 6D:
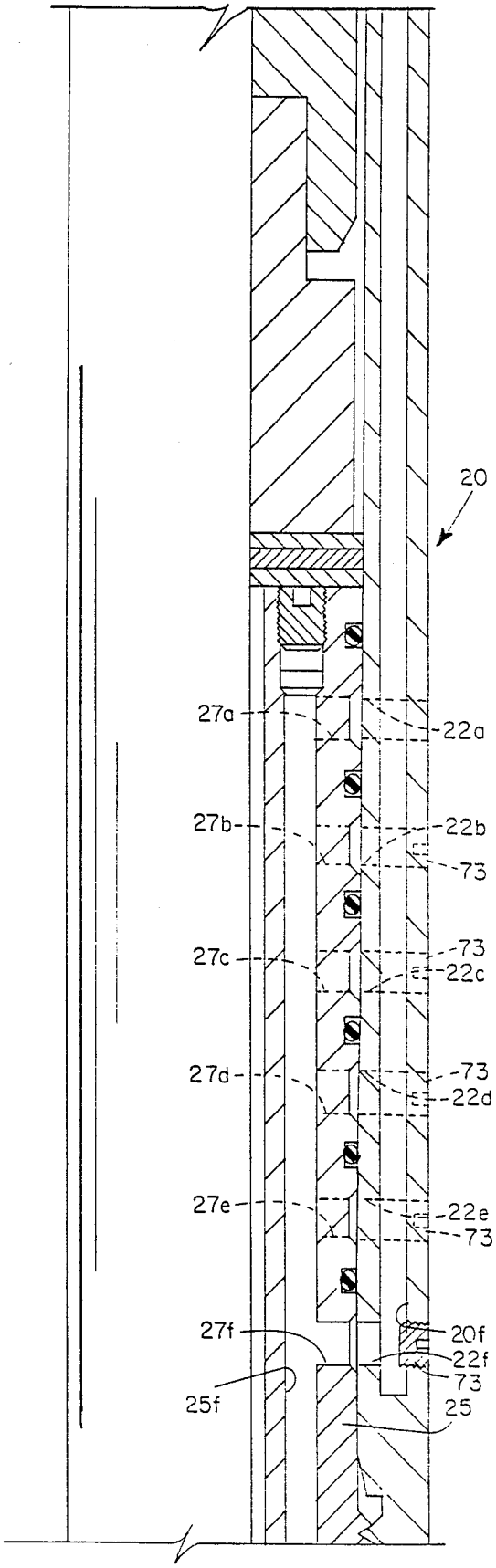
Figure 6E:
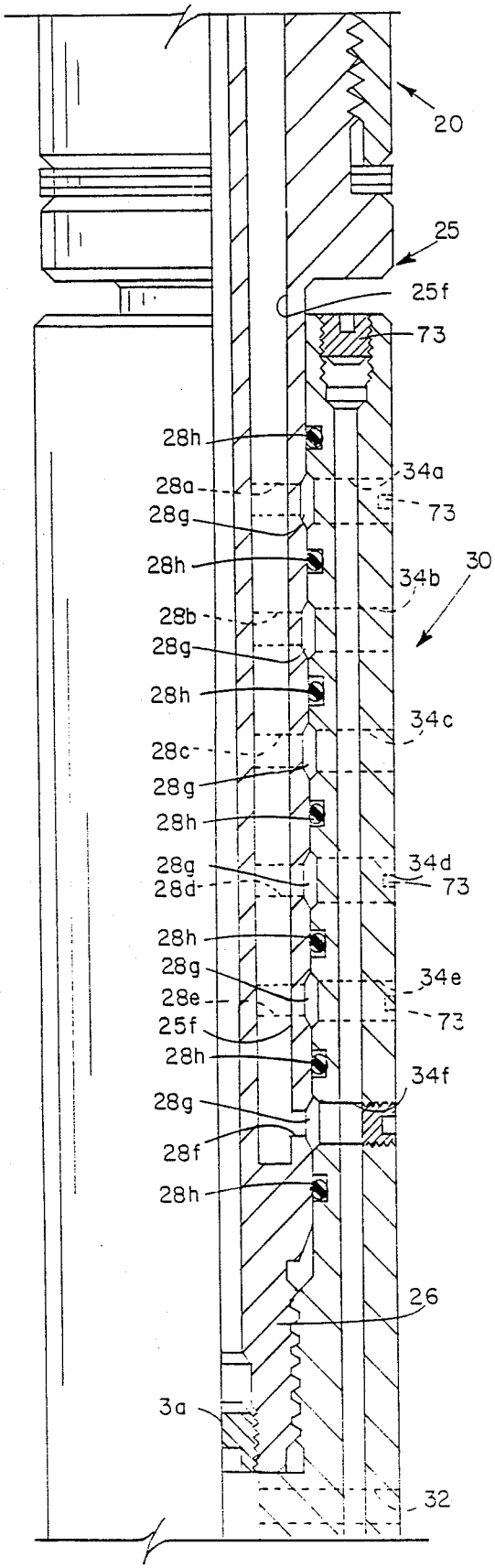
Figure 9:
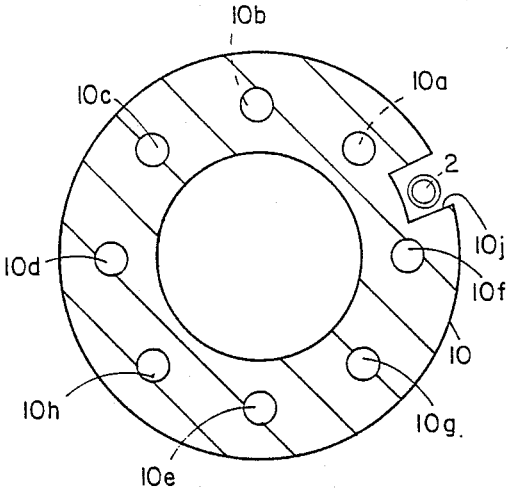
FIG. 9 is an enlarged scale, partial sectional view taken on the plane 9—9 of FIG. 1A.
Figure 12:
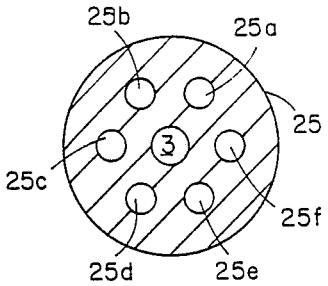
FIG. 12 is an enlarged scale, partial sectional view taken on the plane 12—12 of FIG. 1B.
Figure 10:
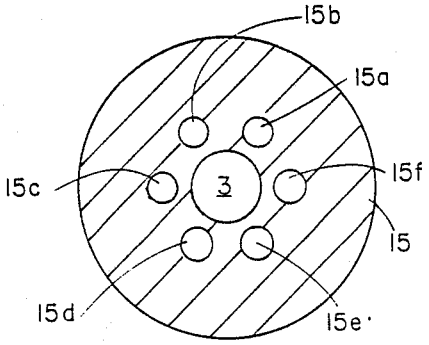
FIG. 10 is an enlarged scale, partial sectional view taken on the plane 10—10 of FIG. 1A.
Figure 13:
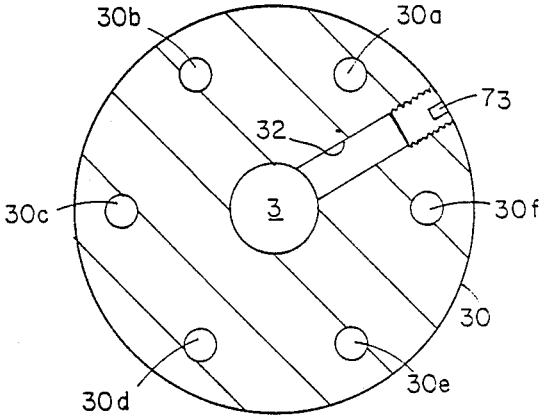
FIG. 13 is an enlarged scale, partial sectional view taken on the plane 13—13 of FIG. 1B.
Figure 11:
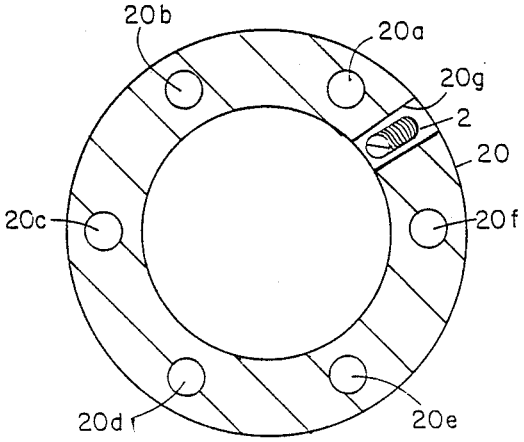
FIG. 11 is an enlarged scale, partial sectional view taken on the plane 11—11 of FIG. 1A.

Referring to FIGS. 1A–1D and 9–19, a hydrological testing apparatus 1 embodying this invention comprises, from the top down, the following serially connected elements. First is a tubular shut-in tool 10 which is supplied by a plurality of peripherally spaced pipes 5*a*, 5*b* etc. with the various fluid and gas pressures required to effect the operation of the tool. Such pipes respectively engage the threaded ends of some of the peripherally spaced axial passages 10*a*, 10*b* . . . 10*h* which are incorporated in the wall of tubular tool 10, as best shown in FIG. 9. The bottom end of tool 10 incorporates a fluid coupling sleeve portion 11 which is threadably secured to a reduced diameter upper portion of a fluid transmission nipple 15 which is provided with peripherally spaced, axial passages 15*a*, 15*b* . . . 15*f* respectively communicating with the axial passages 10*a*, 10*b* . . . 10*f* (FIG. 10) provided in the shut-in tool 10 in a manner to be hereinafter described in detail. The lower end of the fluid coupling nipple 15 is threadably connected to the upper end of a tubular transducer housing 20 through a fluid coupling embodying this invention which provides fluid transmission respectively between each of the nipple axial passages 15*a*, 15*b* . . . 15*f* to axial passages 20*a*, 20*b*, . . . 20*f* provided in the wall of the tubular transducer carrier 20. Within the bore of tubular transducer carrier 20 are mounted three conventional electrical transducers (FIGS. 6A, 6B and 6C) for respectively converting fluid pressures supplied to such transducers into electrical signals which are conveyed to the top end of the apparatus 1 by an electrical cable 2 in a manner that will be hereinafter described.

The lower end of the transducer carrier 20 is provided with a fluid transmission nipple 25 substantially identical to the nipple coupling 15, by which the axially extending fluid passages 20*a*, 20*b* . . . 20*f* (FIG. 11) of the carrier are placed in communication with axial passages 25*a*, 25*b* . . . 25*f* (FIG. 12) provided in nipple coupling 25. The lower end of the nipple coupling 25 is threadably and sealably connected to the top end of a sleeve-type fluid coupling 30 having peripherally spaced, axially extending fluid passages 30*a*, 30*b* . . . 30*f* (FIG. 13) extending through its periphery and respectively connected at its upper end to the axial passages 25*a*, 25*b* . . . 25*f* of the nipple-type fluid transmission coupling 25.

Figure 14:
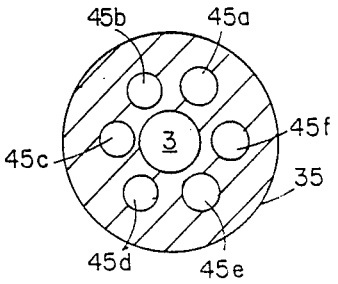
FIG. 14 is an enlarged scale, partial sectional view taken on the plane 14—14 of FIG. 1B.
Figure 15:
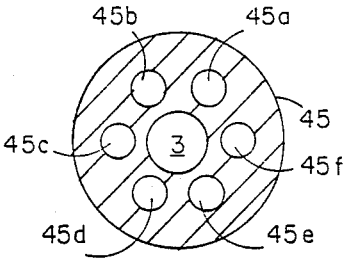
FIG. 15 is an enlarged scale, partial sectional view taken on the plane 15—15 of FIG. 1C.

The lower end of the fluid coupling sleeve 30 is threadably and sealably connected to the top end 35 of a fluid transmission nipple 45 having peripherally spaced, axial fluid passages 45*a*, 45*b* . . . 45*f* (FIGS. 14 and 15). The upper portion of nipple 45 is welded to an annular plug sealably secured into the bore of the tubular body of an upper inflatable packer 40 and the fluid transmission nipple extends downwardly through packer 40. The bottom end of fluid transmission nipple 45 is threadably and sealably connected to a sleeve coupling 50 which is identical to the sleeve coupling 30 previously mentioned. Sleeve coupling 50 is provided with peripherally spaced, axially extending fluid passages 50*a*, 50*b* . . . 50*f* (FIG. 16) which are respectively in fluid communication with the axially extending passages 45*a*, 45*b*, . . . 45*f* provided in the nipple coupling portion 45.

Figure 18:
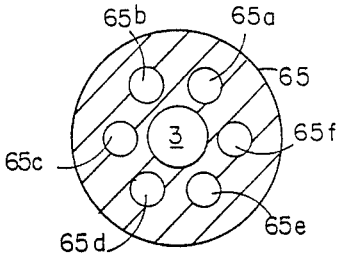
FIG. 18 is an enlarged scale, partial sectional view taken on the plane 18—18 of FIG. 1C.
Figure 16:
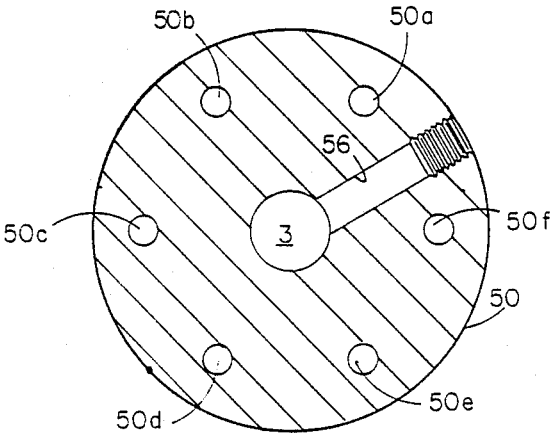
FIG. 16 is an enlarged scale, partial sectional view taken on the plane 16—16 of FIG. 1C.
Figure 19:
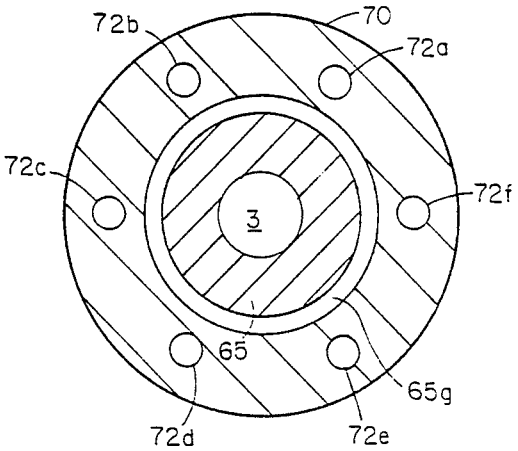
FIG. 19 is an enlarged scale, partial sectional view taken on the plane 19—19 of FIG. 1C.
Figure 17:
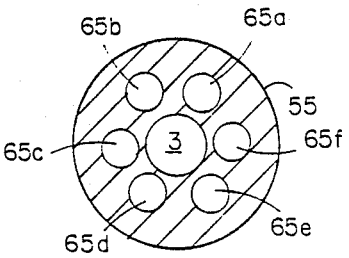
FIG. 17 is an enlarged scale, partial sectional view taken on the plane 17—17 of FIG. 1C.

The bottom end of the sleeve coupling 50 is threadably and sealably secured to the top end 55 of a fluid transmission nipple 65 which is similar to the fluid transmission nipple 45 and is sealably secured in the tubular body of a lower inflatable packer 60. The lower inflatable packer 60 is identical to the upper inflatable packer 40. Fluid transmission nipple 65 defines peripherally spaced, axially extending fluid passages 65*a*, 65*b*, . . . 65*f* (FIGS. 17 and 18). Nipple coupling 65 is threadably and sealably secured to the sleeve coupling end 72 of a tubular fill-up valve 70 having a plurality of peripherally spaced, radially extending ports 72*a*, 72*b* . . . 72*f* (FIG. 19). Within fill-up valve 70 a piston type valve member 76 (FIGS. 2A and 2B) is axially shiftable between an open position, permitting fluid to flow through the open bottom end of the fill-up valve 70 and into at least one of the axially extending interconnected fluid passages heretofore described, to a closed position wherein no fluid from the bore can flow upwardly through the center of the fill-up valve 70.

Generally, one of the interconnected axial fluid passages is employed to concurrently inflate both the upper inflatable packer 40 and the lower inflatable packer 60. Concurrently, the same fluid pressure is utilized to effect a shifting of the piston 76 of the fill-up valve 70 to its closed position. Axial passages 10*f*, 15*f*, 20*f*, 25*f*, 30*f*, 45*f*, 50*f*, 65*f* and port 72*f* may be selected for that purpose.

It is obviously immaterial which of the axial fluid passages provided in the apparatus are employed for the following specific functions. Another one of the interconnected axially extending fluid passages transmits the annulus fluid pressure existing below the inflated lower packer 60 to an appropriate one of the transducer units housed in the transducer carrier 20. A third one of the axial fluid passages transmits the fluid pressure from the zone intermediate the inflated packers 40 and 60 to a second one of the transducer units mounted in the transducer carrier 20. A fourth fluid passage transmits annulus pressure immediately above the upper inflated packer 40 to the third one of the transducer units. Obviously, the fluid passages supplying the three transducer units do not need to extend upwardly beyond the transducer carrier 20 and hence the upper portions of such fluid passages may be closed at the surface by appropriate plugs.

An additional one of the axially extending fluid passages is in communication with the isolated test zone and may be employed to transmit treating fluids to the test zone located between the upper and lower inflatable packers 40 and 60.

The last one of the mentioned axially extending fluid passages is employed as a purge line which supplies pressured gas to the isolated zone between packers 40 and 60 for the purpose of driving out any fluid from such zone. The gas purge passage may also be connected to the inflatable portion of each packer to aid in deflation of such packers.

Additional fluid passages 10*g* and 10*h* are provided in the top of the tool for a specific purpose. One of such axial fluid passage is employed to apply fluid pressure to the shut-in tool to move some to its open position, while a second one of the two extra axial fluid passages in the shut-in tool is employed to shift the shut-in tool to its closed position.

Figures 1A, 1B, 1C, 1D:
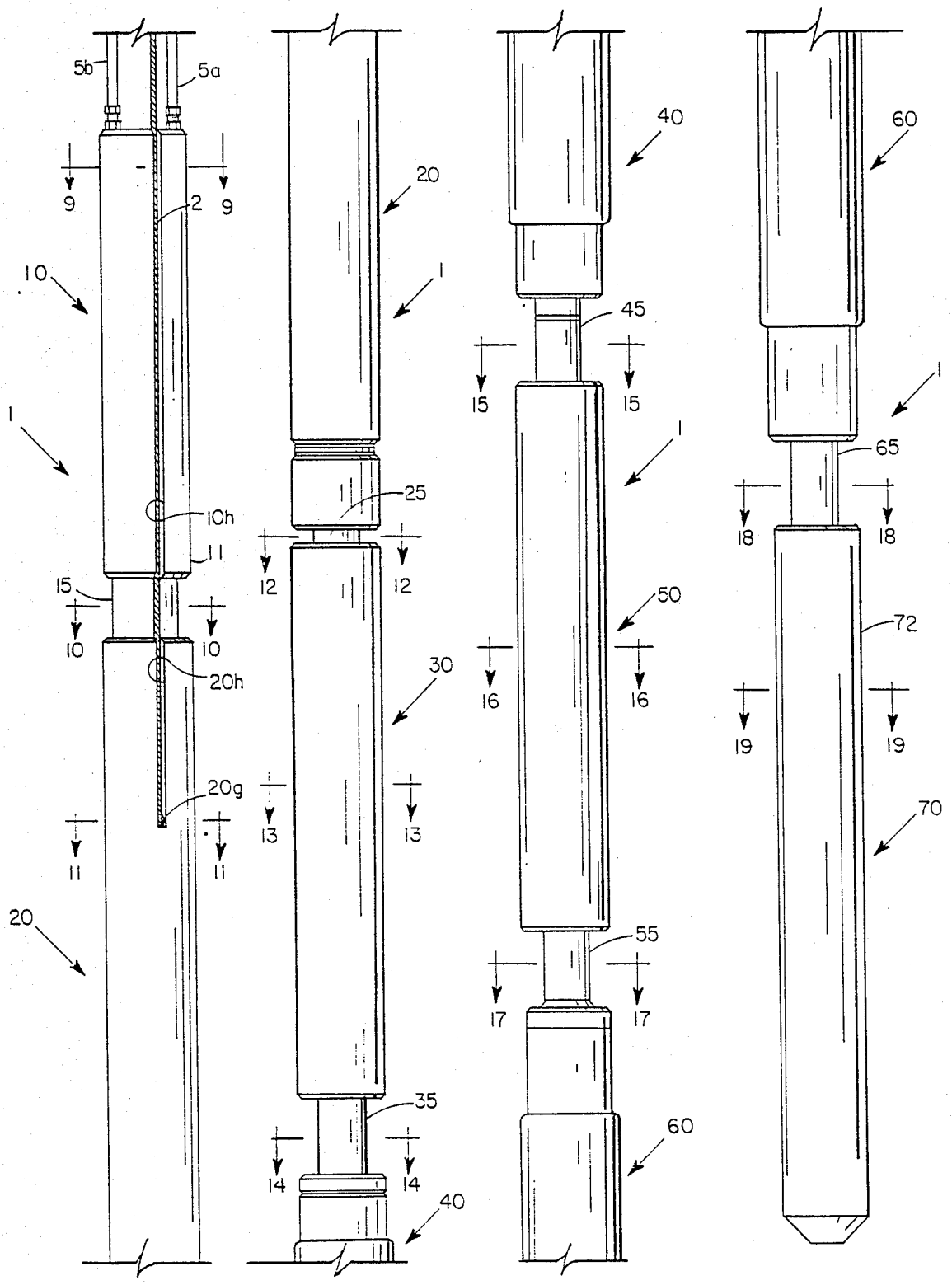
FIGS. 1A, 1B, 1C and 1D collectively represent a schematic elevational view of a radiological testing apparatus embodying this invention.
Figure 2A:
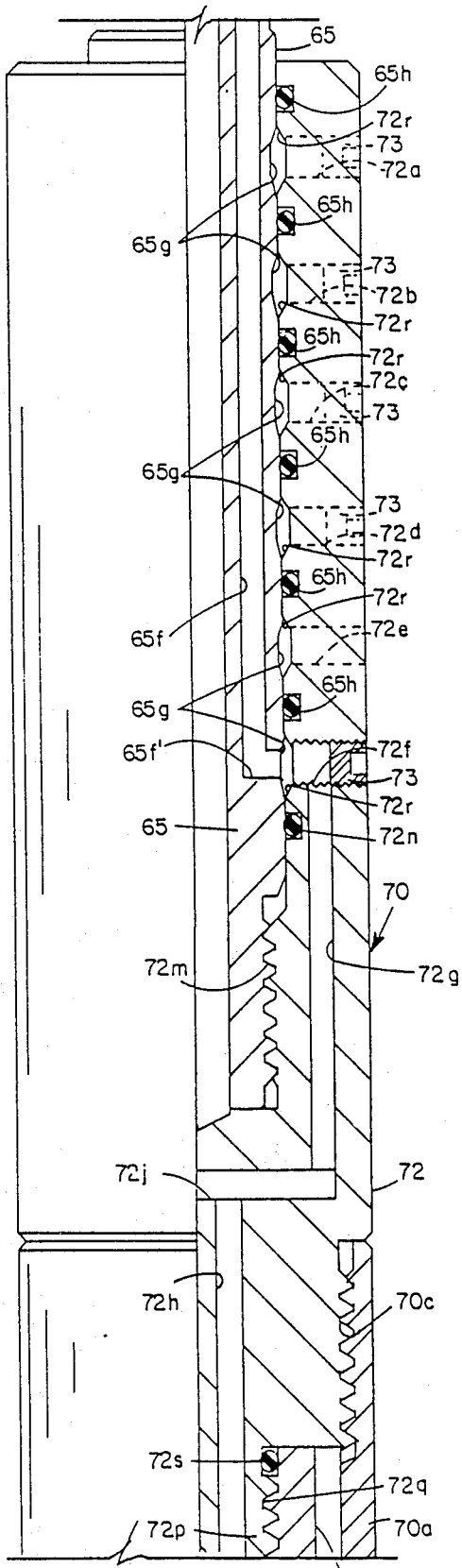
FIGS. 2A and 2B collectively constitute an enlarged scale, vertical quarter-sectional view of the fill-up valve provided at the bottom of the apparatus of FIGS. 1A–1D with the valve element shown in the open position.
Figure 2B:
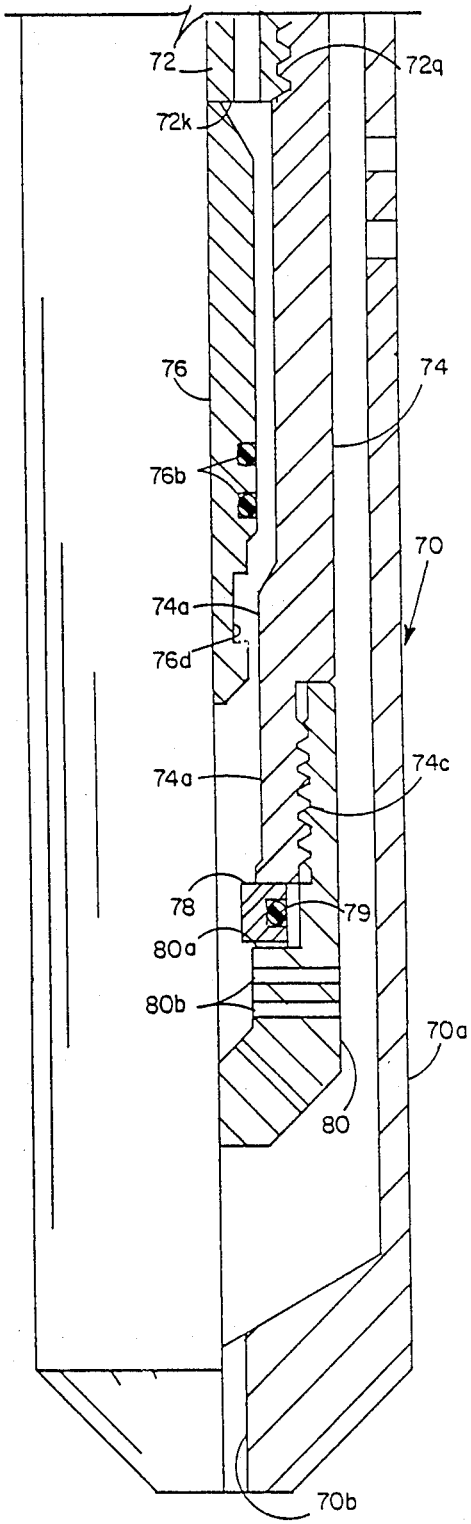
Figure 2C:
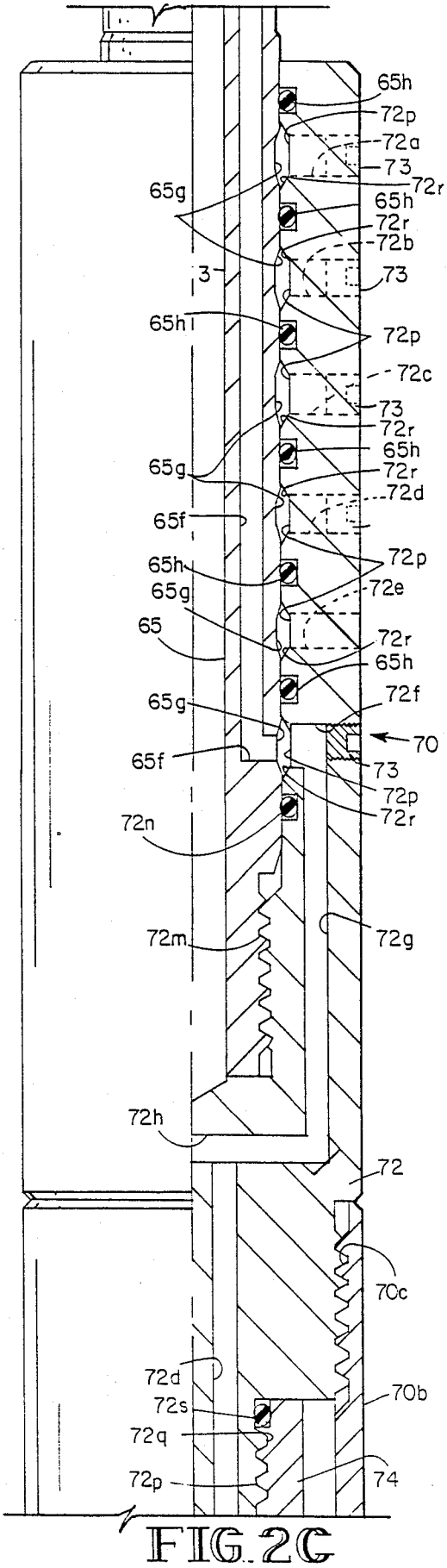
FIGS. 2C and 2D are views respectively similar to FIGS. 2A and 2B but showing the valve element in its closed position.

Referring now to the enlarged scale drawings, the fill-up valve 70 is illustrated in FIGS. 2A, and 2B in the open position of the valve. Fill-up valve 70 comprises a tubular housing 70*a* having a constricted axial opening 70*b* at its lower end. The upper end of tubular body 70*a* is provided with internal threads 70*c* which are threadably engaged with a fluid communication sub 72. Communication sub 72 has a radially thickened top end portion within which are formed a plurality of radial ports 72*a*, 72*b* . . . 72*f*. Said ports 72*a*, 72*b* . . . 72*f* are both axially and peripherally spaced around the periphery of connecting sub 72. Additionally, all of the ports except a selected one, here shown as port 72*e*, is sealed at the surface by a threaded plug 73. The port 72*e* thus communicates with the annulus existing below the lower inflated packer 60 and may be utilized to transmit the fluid pressure to one of the transducer units mounted in the transducer carrier 20. Fluid transmission sub 72 is also provided with an axial extending fluid passage 72*g* which communicates between radial port 72*f* and radial passage 72*j* which connects with an axial passage 72*h* which opens in the bottom face 72*k* of the fluid communication sub 72.

Fluid communication sub 72 is further provided at its upper end with internal threads 72*m* which engage external threads provided on the bottom end of the fluid transmission nipple 65. This threaded connection is sealed by an O-ring 72*n*. Fluid transmission nipple 65 is, as previously mentioned, provided with a plurality of peripherally spaced, axially extending fluid passages 65*a*, 65*b* . . . 65*f*. None of these passages extend entirely through the nipple 65 and each passage terminates at its lower end in a radial port, of which only the port 65*f'* is shown in FIG. 2A. All of the radial ports communicate with annular recesses 65*g* formed on the periphery of the fluid transmission nipple 65 and disposed in opposed relationship to annular internal recesses 72*r* formed on the fluid transmission sub 72. O-rings 65*h* are respectively provided between each of the annular recesses 65*g* and thus the fluid connections between the axial passages 65*a*, 65*b*, . . . 65*f* and the radial ports 72*a*, 72*b*, . . . 72*f*, are effectively sealed.

Figure 2D:
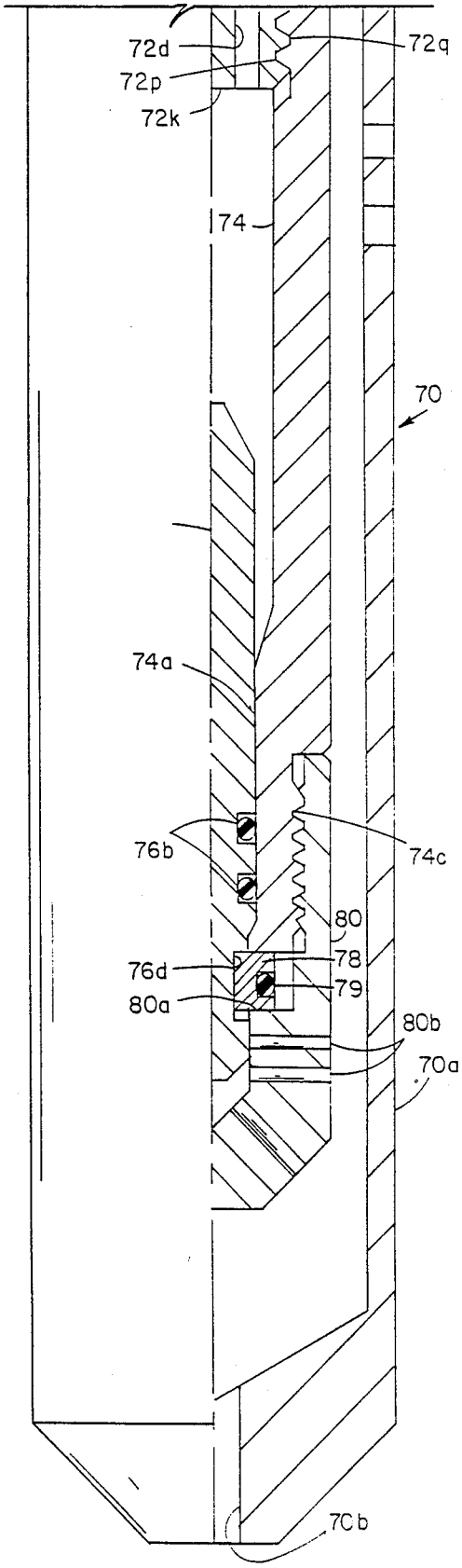

The fluid communication sub 72 is provided with a reduced diameter lower section 72*p* which is provided with external threads 72*q*. A cylinder sleeve 74 is threadably mounted on the threads 72*q* and the threaded connection is sealed by an O-ring 72*n*. The lower portion of the cylinder sleeve 74 defines an internal cylindrical sealing surface 74*a*. An annular piston 76 is mounted in slidable and sealing relationship with cylindrical sealing surface 74*a* by O-rings 76*b*. Thus, the application of a fluid pressure to the top end of the piston 76 will result in the piston 76 moving downwardly to bring the Orings 76*b* in contact with cylindrical surface 74*a* and thus effect a sealing of the fluid passage otherwise provided through the central portions of the fill-up valve 70. The closed position of the piston 76 is illustrated in FIG. 2D.

A mechanism is provided to secure the piston 76 in its closed position. Such mechanism comprises a segmented lock ring 78 which is peripherally secured by an O-ring 79. Ring 78 is mounted between an upwardly facing surface 80*a* formed on a retention plug 80 which is secured to external threads 74*c* provided on the bottom exterior portion of the cylinder sleeve 74. When piston 76 is driven downwardly to its locked position shown in FIG. 2D, the segmented lock ring 78 snaps inwardly into an annular recess 76*d* provided on the exterior of the piston 76. Radial ports 80*b* are provided through the retainer sleeve 80 to permit discharge of fluid trapped in plug 80 below the bottom of piston 76.

Figure 3A:
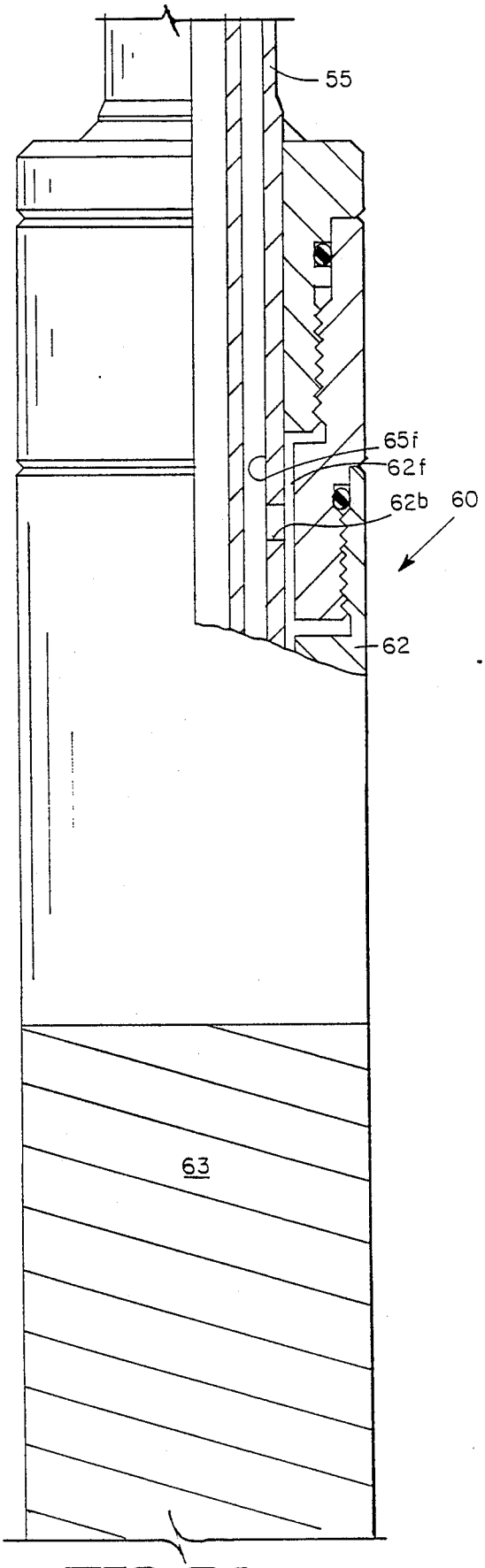
FIGS. 3A and 3B collectively constitute an enlarged scale elevational view of the lower inflatable packer, with the end portions in section.
Figure 3B:
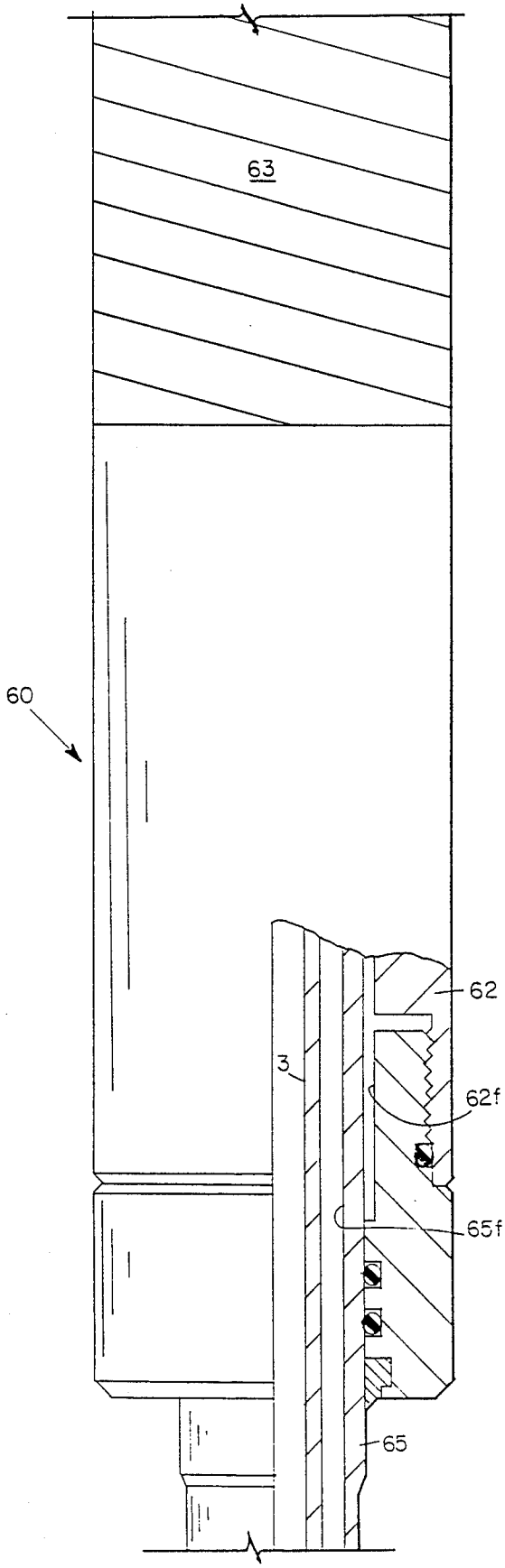

The upper portion of the nipple coupling 65 extends entirely through the bore of the lower inflatable packer 60 and is sealably connected to the bottom end of the lower inflatable packer unit 60. As best shown in FIGS. 3A, and 3B, inflatable packer unit 60 comprises a tubular body assembly 62 which defines an annular chamber 62*f* surrounding the nipple 65. One or more radial ports 62*b* connects nipple axial passage 65*f* with annular chamber 62*f*.

The remainder of the construction of the lower inflatable packer 60 is entirely conventional and it will be understood by those skilled in the art that since the annular chamber 62*f* is provided with a fluid connection 62*b* to the axial passage 65*f* in nipplet 65, then when fluid pressure is supplied to axial passage 10*f* at the top of the tool, it will cause the inflation of the inflatable portion 63 of lower packer 60 into sealing engagement with the well bore.

Figure 4A:
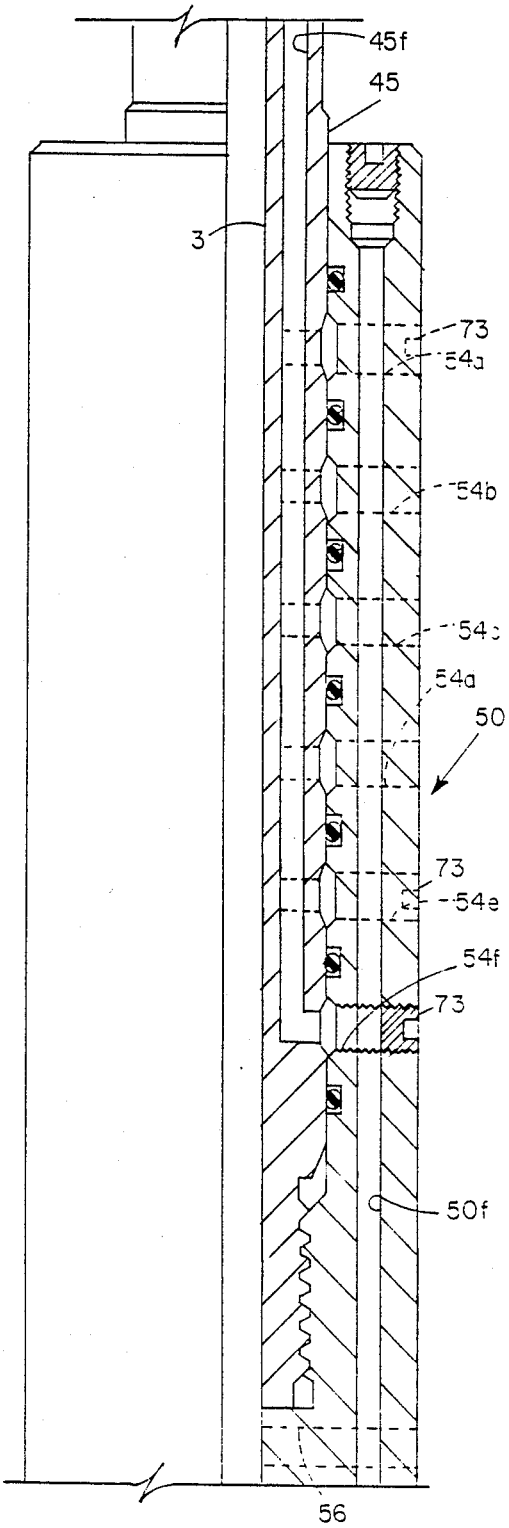
FIGS. 4A and 4B collectively constitute an enlarged scale, quarter-sectional view of a coupling sleeve repeatedly utilized in assembling the apparatus of FIGS. 1A–1D.
Figure 4B:
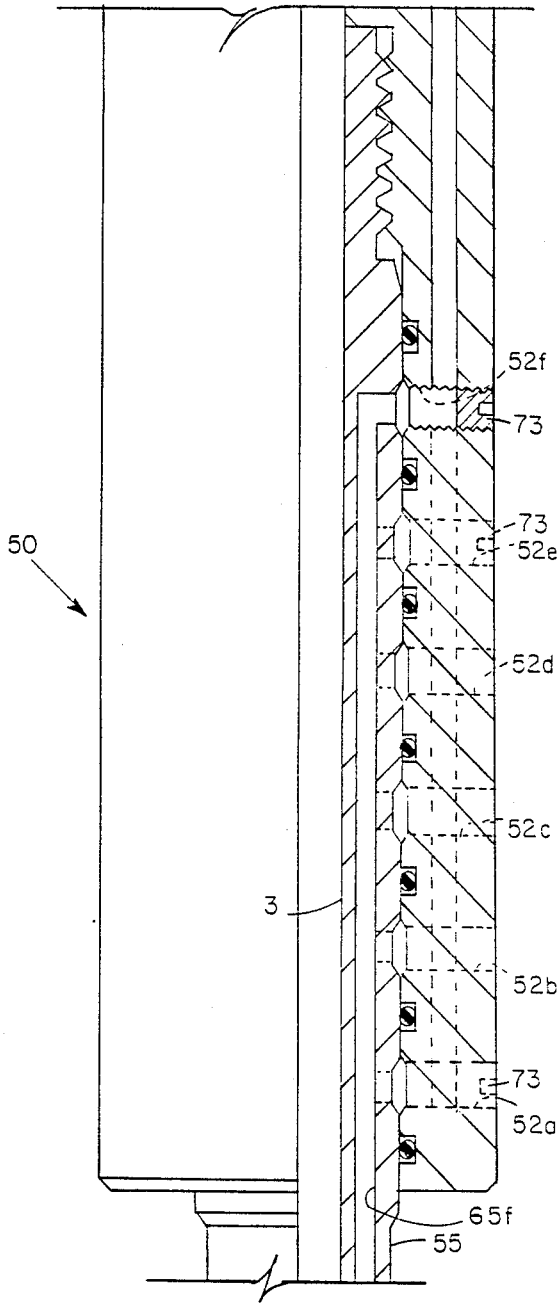
Figure 5A:
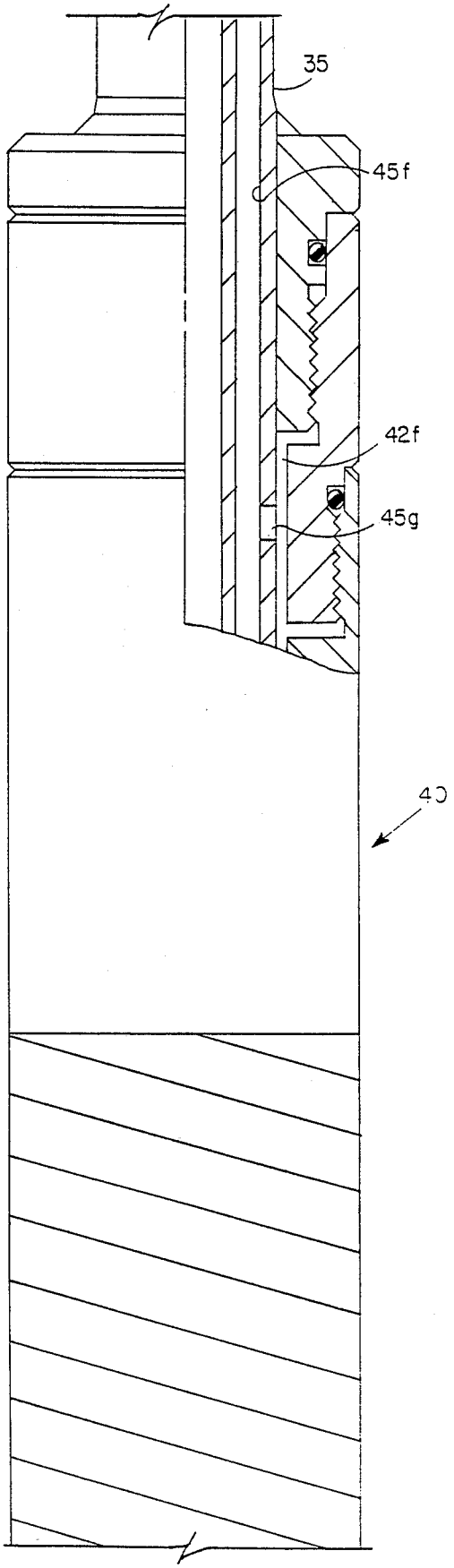
FIGS. 5A and 5B are views similar to FIGS. 3A and 3B of the upper inflatable packer.
Figure 5B:
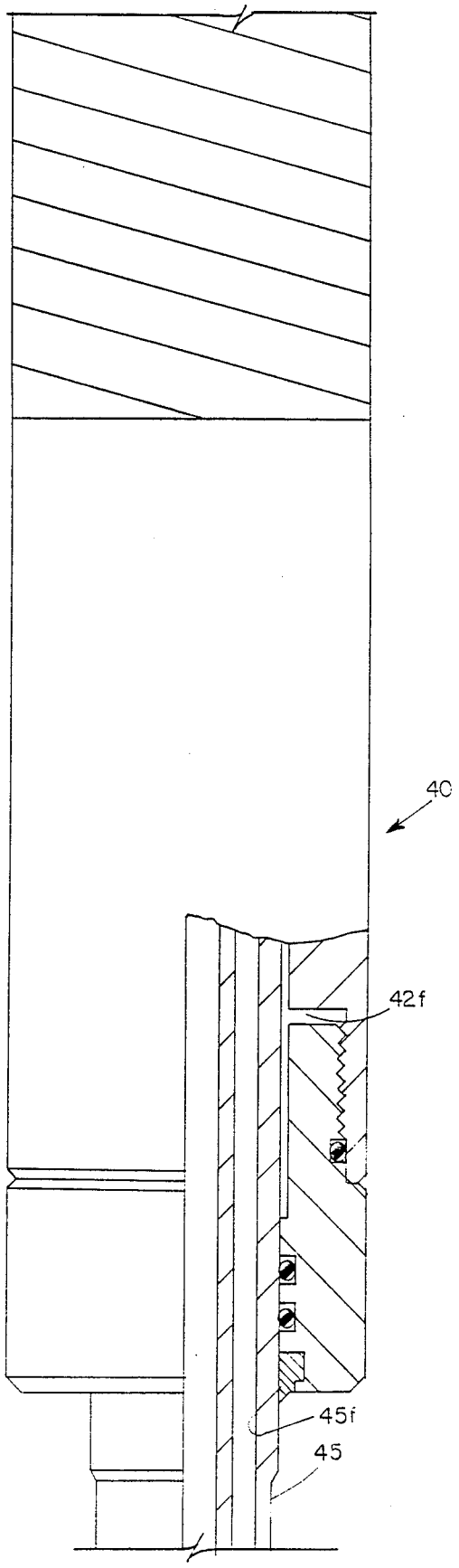

The upper end 55 of fluid transmission nipple 65 is of the same construction as the lower end of fluid transmission nipple 65 previously described and hence not be again described in detail. Suffice it to say the upper end 55 of fluid transmission nipple 65 also encloses the peripherally spaced, axially extending passages 65*a*, 65*b* . . . 65*f* and is connectable to a sleeve type fluid coupling 50 which is disposed between the upper and lower inflatable packers. The sleeve type fluid coupling 50 surrounds the upper portion 55 of the fluid transmission nipple 65 and the lower portion of the fluid transmission nipple 45. Axially extending, peripherally spaced fluid passages 50*a*, 50*b* . . . 50*f* (FIG. 16) are provided in fluid coupling 50 and respectively communicate with the corresponding axial passages within the lower fluid transmission nipple 55 and with the upper fluid transmission nipple 45. Thus, at the lower end of the sleeve coupling 50, a plurality of axially and peripherally spaced radial ports 52*a*, 52*b* . . . 52*f* are arranged in respective communication with axial fluid passages 65*a*, 65*b* . . . 65*f*. Similarly, in the upper end of the fluid coupling sleeve 50, radial ports 54*a*, 54*b* . . . 54*f* are disposed in fluid communication with the peripherally spaced, axially extending passages 45*a*, 45*b* . . . 45*f* provided in the fluid transmission nipple 45. Plugs 73 are, of course, mounted at the surface in the outer ends of selected ones of the aforementioned radial ports in the fluid coupling sleeve 50 to prevent undesired fluid communication with the zone between the upper packer 40 and the lower packer 60. Three dual sets of radial ports, respectively 52*b* and 54*b*, 52*c* and 54*c*, and 52*d* and 54*d*, are left unplugged to provide three parallel fluid passages from the test zone to the top of the tool. Additionally, a radial port 56 (FIG. 4A) extends through a wall of the coupling 50 and into the central bore 3 of the tubular structure, thus providing communication between the central bore 3 of the tool and the isolated zone between the upper and lower inflated packers for fluid treatment purposes.

The upper portion 35 of the fluid transmission nipple 45 is sealably inserted in the lower end of the upper packer 40 and extends the peripherally spaced, axial passages 45*a*, 45*b* . . . 45*f* through the entire upper packer 40, in the same manner as heretofor described in connection with the lower inflatable packer 60. A suitable radial port 45*g* is provided to connect an annular passage 42*a* in the interior of the inflatable portion of inflatable packer 40 to the axially extending fluid passage 45*f*, which, it will be recalled, is also in fluid communication with the inflatable portion of the lower inflatable packer 60.

Figure 6F:
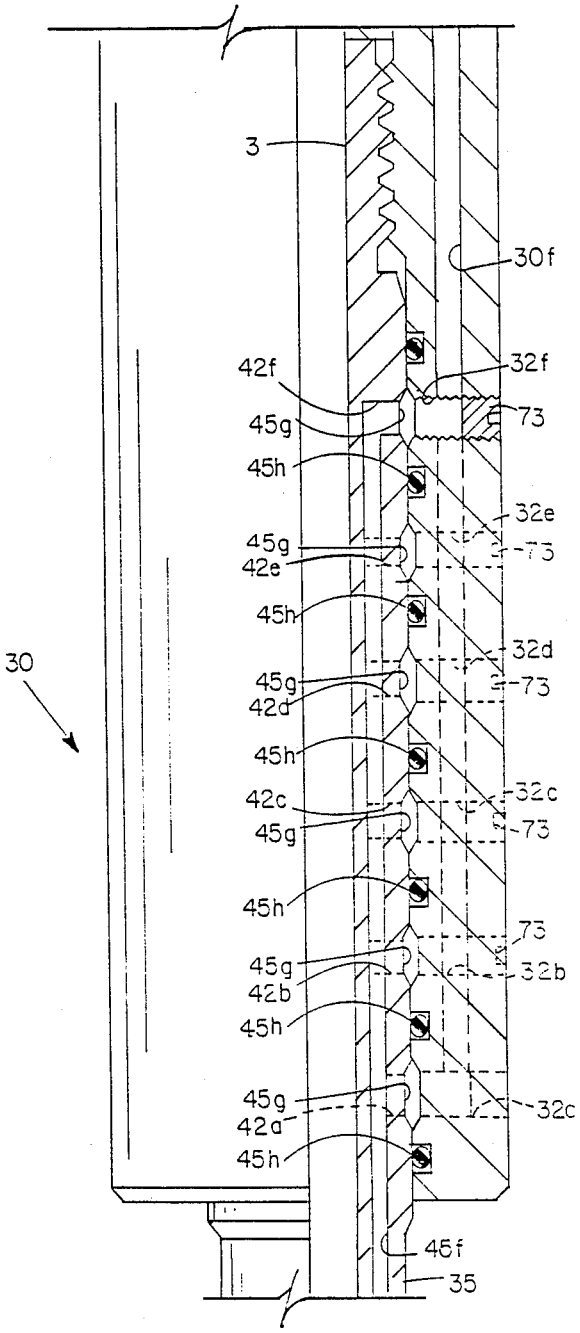

The upper end 35 of fluid transmission nipple 45, identical to the upper end 55 of the fluid transmission nipple 65 is provided to connect the top end of the upper inflatable packer 40 to the lower end of the coupling sleeve 30 (FIG. 6F). Coupling sleeve 30 is of substantially the same construction as the coupling sleeve 50 previously described, and provides fluid communication between the various axially extending passages 45*a*, 45*b* . . . 43*f* of the fluid transmission nipple 45 and a lower nipple portion of a fluid coupling nipple 25. Such fluid communication includes radial ports 42*a*, 42*b* . . . 42*f* in nipple 45, annular recesses 45*g* intersecting each radial port, radial ports 32*a*, 32*b* . . . 32*f* in the lower end of coupling sleeve 30 communicating respectively between ports 42*a*, 42*b* . . . 42*f* and axial passages 30*a*, 30*b* . . . 30*f* in coupling sleeve 30. O-rings 45*h* maintain a separation between the respective radial ports. Exactly similar communicating ports, annular recesses, and O-ring seals are provided at the top of coupling sleeve 30. The radial ports in the bottom portion 26 of fluid transmission nipple 25 are numbered 28*a*, 28*b* . . . 28*f*; the annular recesses are 28*g*; the O-rings are 28*h*, and the respectively connecting radial ports in coupling sleeve 30 are 34*a*, 34*b* . . . 34*f*.

Coupling 30 is provided with a centrally located radial port 32 extending from the exterior of the coupling sleeve to the internal bore 3 of the tubular apparatus. Upward fluid passage through the central bore 3 is normally prevented by a plug 3*a* inserted in the bottom end of the lower nipple portion 26 of the fluid coupling nipple 25. A plug 73 is inserted at the surface in the radial port 32 to prevent fluid passage from the central bore 3 to the exterior of the tool unless desired for a specific purpose. Notwithstanding the interruption of any flow through the central bore 3, it should be noted that the test zone between the upper and lower inflatable packers is preferably in fluid communication with three axially extending passages 30*b*, 30*c* and 30*d*, which extend to the top portion of the tool through the peripherally located passages.

The fluid coupling nipple 25 is provided to connect the upper end of the sleeve coupling 30 to the lower end of the transducer carrier 20. The nipple 25 is of the same general configuration as the fluid transmission nipples previously described and provides a plurality of axially spaced fluid passages 25*a*, 25*b* . . . 25*f* which, at their lower ends, are in communication with radial ports 28*a*, 28*b* . . . 28*f*, and at their upper ends are in communication with radial ports 27*a*, 27*b* . . . 25*f*, which are in turn in communication with axially and peripherally spaced radial ports 22*a*, 22*b* . . . 22*f* provided in the lower end of the tubular transducer carrier 20 and respectively communicate with axially extending passages 20*a*, 20*b* . . . 20*f* which extend substantially the full length of the transducer carrier 20. Plugs 73 are provided at the surface in the outer ends of ports 22*b*, 22*c*, 22*d*, 22*e* and 22*f*.

Within the central bore of the transducer carrier 20, there is sealingly mounted three conventional transducers 21*a*, 21*b* and 21*c* for converting fluid pressure signals into electrical signals. Such transducers are only shown schematically. The lowermost transducer 21*a* may, for example, be connected by a radial port A to the axial fluid passage 20*e* which provides communication with the fluid pressure existing in the annulus surrounding the fill-up valve 70 at the bottom of the tool. The second transducer 21*b* may be provided with a radial port B which is connected to one or both of the fluid passages 20*b* or 20*c* which communicate with the fluid pressure existing in the isolated zone between the upper packer 40 and the lower packer 60. The third transducer 21*c* may be connected by a radial port C to the axial passage 20*a* which communicates with the annulus pressure existing above the upper inflated packer 40.

Thus, electrical signals are generated by transducers 21*a*, 21*b* and 21*c* respectively proportional to fluid pressures existing within the isolated zone and above and below the isolated zone and are carried to the top of the tool by an electrical cable 2 which passes through an upwardly and diagonally extending slot 20*g* provided in the wall of transducer carrier 20 and communicating with an axially extending external slot 20*h* extending to the top of the transducer carrier 20. If desired, the slot 20*h* may in effect be continued by an aligned, external axially extending slot 10*j* provided in the outer wall of the shut-in tool 10.

The upper end portion of the tubular transducer carrier 20 is threadably and sealably secured to a fluid transmission nipple 15 which is of the same configuration as the other fluid transmission nipples heretofor described. Thus, nipple 15 is provided with a plurality of peripherally spaced, axially extending passages 15*a*, 15*b* . . . 15*f* which respectively communicate through radial ports 16*a*, 16*b* . . . 16*f* in nipple 15, with radial ports 22*a*, 22*b* . . . 22*f* in the upper end of transducer carrier 20. At the top end of nipple 15, radial ports 17*a*, 17*b* . . . 17*f* communicate with axial ports 10*a*, 10*b* . . . 10*f* provided in the shutin tool 10 through radial ports 11*a*, 11*b* . . . 11*f* provided at the surface in the shut-in tool 10. Plugs 73 are inserted in each of the radial ports 11*a*, 11*b* . . . 11*f* where required to preserve the continuity of the peripherally spaced, axially extending passages. The axially extending passages 10*b*, 10*c*, 10*c*, 10*d* and 10*f* are provided with openings in the upper end face of the shut-in tool 10 and these passages are connected by the pipes 5*b*, 5*c*, 5*d* and 5*f* to extend to appropriate fluid pressure sources.

In the case of the passages 10*b* and 10*c*, such fluid pressure may constitute sources of treatment fluid so that treatment fluid may be supplied to the isolated zone in substantial quantities regardless of the fact that the central bore passage 3 in the tool is blocked by the transducers located in the bore of the transducer carrier 20. The third pipe 5*d* may be utilized to connect the axial passage 10*d* to a source of gas or other purging fluid so that the fluids existing in the isolated zone may be purged by supplying pressurized gas through the axial passage 10*d* and the continuation axial passages provided in the other elements of the tool, as previously described. If desired, the purging passages may also be connected by suitable radial ports (not shown) to the interior of the inflatable portions of the upper packer 40 and the lower packer 60 to aid in discharging liquid from such packers when deflation of the packers is desired. Pipe 5*f* supplies packer inflating pressure to axial passage 10*f*.

The shut-in tool 10 preferably includes two additional axial passages 10*g* and 10*h* (FIG. 9). These passages are employed to effect the shifting of a piston type valving element 13 between a closed position preventing fluid flow from the source of fluid pressure to the tool bore 3, or to an open position permitting fluid flow from the source of fluid pressure through the tool bore 3 for the purpose of supplying well treatment fluid to the isolated zone between the upper packer 40 and the lower packer 60. This requires removal of the transducer carrier sleeve 20 to open the bore 3.

Figure 7A:
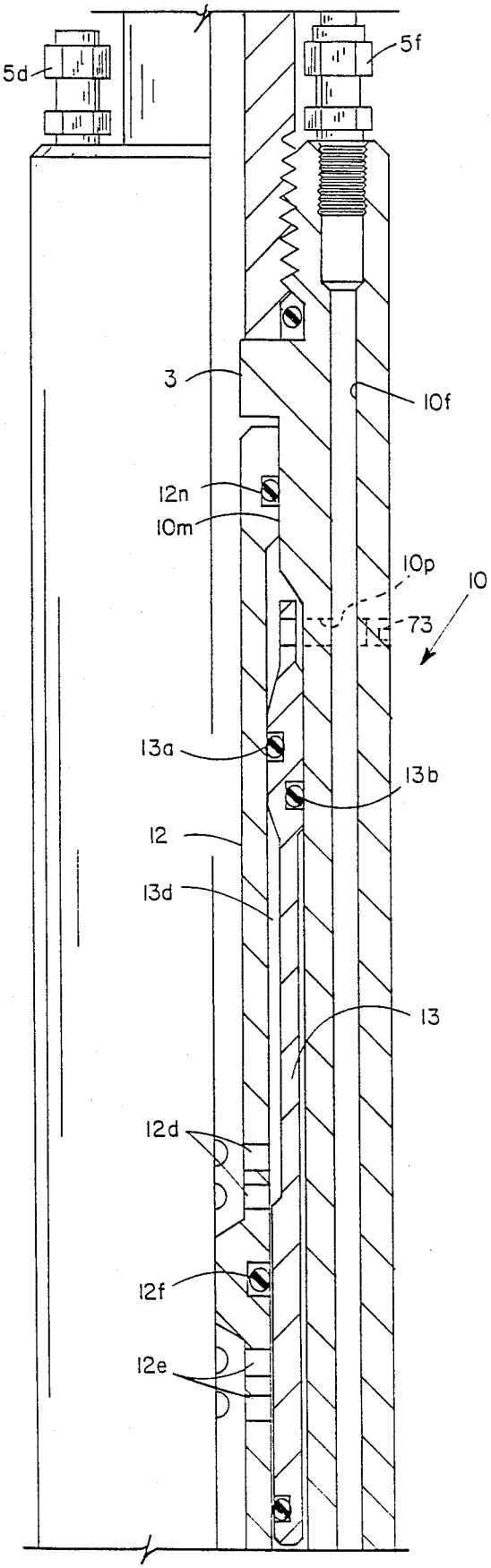
FIGS. 7A and 7B collectively constitute an enlarged scale vertical quarter sectional view of a shut-in tool mounted at the top of the apparatus of FIGS. 1A–1D, with the elements of the shut-in tool shown in their open position.
Figure 7B:
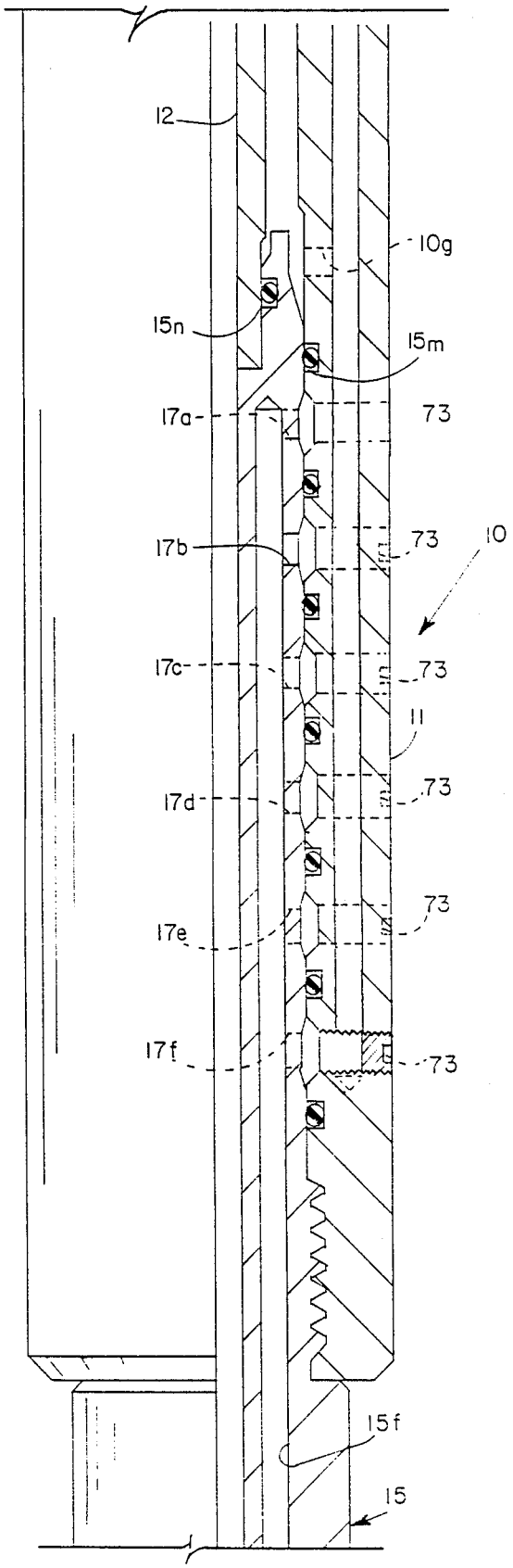
Figure 8A:
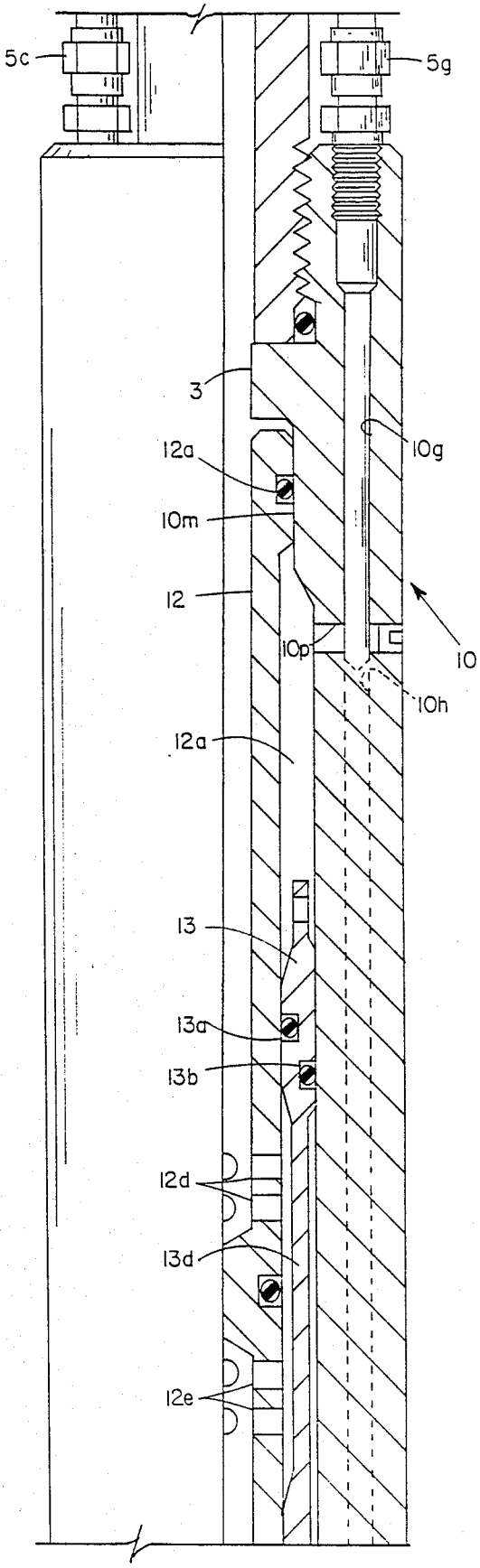
FIGS. 8A and 8B are quarter sectional views on a different plane than FIGS. 7A and 7B but showing the elements of the shut-in tool shifted to their flow preventing positions.
Figure 8B:
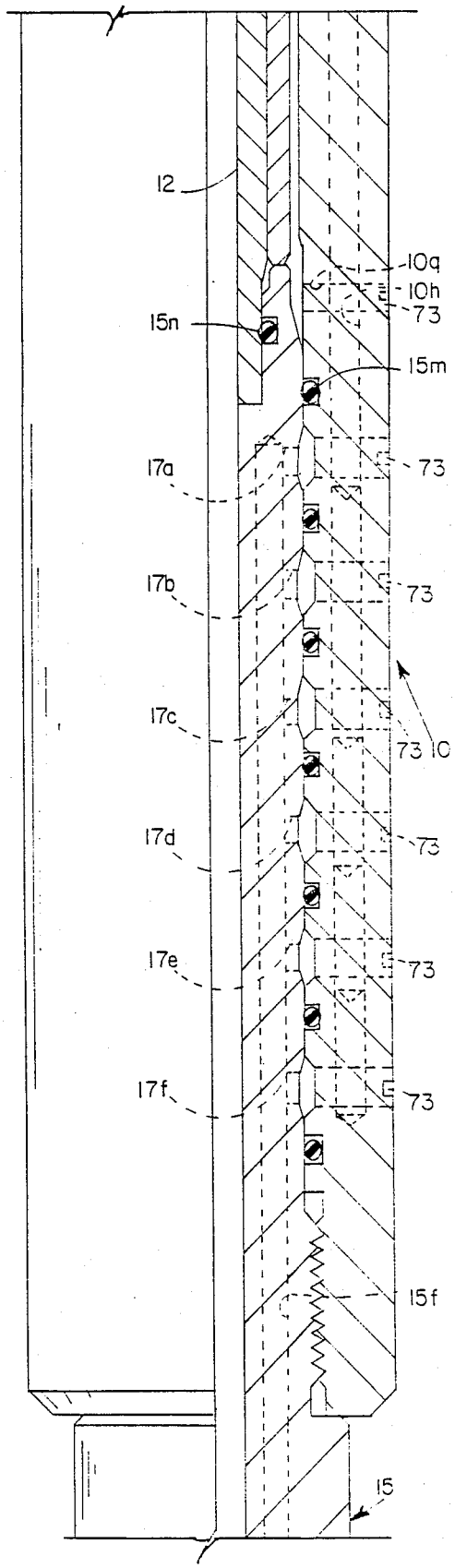

To effect such valving action, a cylinder sleeve 12 is sealably mounted within the interior of the tubular shut-in tool 10, being held in position by the upper end 15*m* of the fluid coupling nipple 15 and defining an annular fluid pressure chamber 12*a* which is sealed at one end by an O-ring seal 15*n* mounted in the top end 15*m* of the fluid coupling nipple 15, and by an O-ring 12*n* mounted in the upper end of the cylinder sleeve 12 and engaging an internal cylindrical surface 10*m* formed in the bore of the tubular shut-in tool 10. Within the fluid pressure chamber 12*a*, a valving piston 13 is slidably mounted and is sealed by O-rings 13*a* and 13*b*. Fluid pressure applied through a suitable pipe (not shown) and the axial passage 10*g* is conducted by a port 10*p* (FIG. 8B) to the upper end of the fluid pressure chamber 12*a* to exert a downward force on the valving piston 13, and fluid pressure is conducted through axial passage 10*h* through a radial port 10*q* to apply fluid pressure to the lower portion of the valving piston 13. Thus, the valving piston 13 may be shifted from the closed position in FIGS. 7A and 7B to the open position shown in FIGS. 8A and 8B. In the closed position, flow through radial ports 12*d* and 12*e* provided in the cylinder sleeve 12 on each axial side of an O-ring 12*f* is prevented by the O-ring 12*f*. In the open position shown in FIGS. 8A and 8B, an annular recess 13*d* provided on the inner surface of the valving piston 13 overlaps the ports 12*d* and 12*e* and permits fluid flow through the central bore 3 of the shut-in tool 10.

With such shut-in tool, plus the removal of the transducer units 21*a*, 21*b* and 21*c* from the central portions of the transducer carrier 20, or the removal of carrier 20 from the tool string and the substitution of a fluid transmission coupling sleeve therefor, treatment fluid can be supplied through the central bore 3 to the isolated perforated zone between the upper packer 60 and the lower packer 40 and the tool employed solely as a formation treatment tool.

Those skilled in the art will notice that the fluid transmission nipples 45 and 65 would require the drilling of excessively long holes to provide the peripherally spaced, axially extending fluid passages heretofore described. While these passages have been shown as circular holes in the drawings, as a practical matter, they are more conveniently formed as slots cut into the periphery of the respective fluid transmission nipple and then a covering strip of metal is welded across the top of each slot. This is merely a matter of manufacturing procedure and in no way effects the accuracy of the foregoing disclosure for which the term passages is meant to include either holes or slots closed by a weldment.

It should also be noted that each of the peripherally spaced, axially extending passages heretofore referred to, do not extend through the ends of either the nipple elements or the sleeve elements in which they are formed. Suitable plugs are provided in each end, or in the case of drilled holes, the hole at one end is not drilled through the entire length of the respective nipple or coupling element. Further, the axial passages are separately maintained regardless of the relative angular positions of the bodies in which they are formed. Hence, ordinary threaded connections may be employed between each of the bodies in the tool string.

The operation of the apparatus embodying this invention has been described in connection with the detailed description of the components thereof. Thus the operation of the described couplings and the peripherally spaced passageways in the tubular components connected by such couplings in separately transmitting different fluids to or from the inflatable packers and the three formation regions adjacent the inflatable packers is obvious from the preceding description. The entire tool assemblage, including the two axially spaced inflatable packers is run into the well to a position where the inflatable packers straddle a selected formation. One of the peripherally spaced, axial passages extend from the well surface to both inflatable packers so that pressured fluid supplied to that axial passage concurrently inflates both packers. Once the packers are set, the other peripherally spaced, axial passage may be employed to perform any or all of the functions previously described.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desire to be secured by Letters Patent is:

1. In a tool for concurrently separately supplying or receiving a plurality of of pressured fluids in a selected isolated zone of a subterranean bore in an upper zone above the selected zone and lower zone below the selected zone, the improvement comprising:

a multi-section tubular conduit extending to the selected zone, each said tubular conduit section defining a plurality of peripherally spaced, axially extending fluid passages extending substantially the entire length of each tubular section;

means for closing each end of each said passage;

a plurality of peripherally spaced, radial ports in each end of said tubular conduit section respectively communicating with said axially extending passages;

a tubular coupling telescopically joining two adjacent ends of two said tubular conduit sections;

said tubular coupling defining a plurality of peripherally spaced, axially extending fluid paths equal in number and peripheral spacing to said fluid passages in said conduit sections;

means for closing the axial ends of said fluid paths in said tubular coupling; and radial port means in each end of said tubular coupling respectively communicating between said fluid paths and the radial ports in each said telescopically related tubular conduit section, whereby continuous flow paths are established between said axial fluid passages of said adjacent tubular conduit sections.

2. The apparatus of claim 1 wherein said continuous flow paths include a radial outward flow path at one end of said tubular coupling and a radially inward flow path at the other end of said tubular coupling.

3. The apparatus of claim 1 wherein each said conduit section defines an annular recess for each fluid passage and said radial ports respectively communicate with said annular recesses; and seal rings disposed on both axial sides of said annular recesses to maintain said fluid passages isolated from each other.

4. The apparatus of claim 3 wherein said tubular coupling defines an annular groove aligned with each said annular recess and communicating with only one of said radial port means in said tubular coupling.

5. The apparatus of claim 1 further comprising means for respectively connecting a plurality of said fluid passages in said tubular conduit to a plurality of separated zones of the subterranean bore.

6. A well tool string for providing a multiplicity of fluid channels respectively communicating between various selected zones of a subterranean bore and the bore entry, comprising, in combination, a multi-section tubular conduit extending to and through the selected zones, each said tubular conduit section defining a plurality of peripherally spaced, axially extending fluid passages extending substantially the entire length of each tubular section; means for closing each end of each said passage; a plurality of peripherally and axially spaced radial ports in each end of said tubular conduit section respectively communicating with said axially extending passages; a coupling sleeve telescopically joining two adjacent ends of two said tubular conduit sections; said coupling sleeve defining a plurality of peripherally spaced, axially extending fluid paths equal in number and peripheral spacing of said fluid passages in said conduit sections; means for closing the axial ends of said fluid paths in said coupling sleeve; and radial port means in each end of said coupling sleeve respectively communicating between said fluid paths and the radial ports in each said telescopically related tubular conduit section, whereby continuous flow paths are established between said axial fluid passages of said adjacent tubular conduit sections.

7. The apparatus of claim 6 wherein said continuous flow paths include a radial outward flow path at one end of said coupling sleeve and a radially inward flow path at the other end of said coupling sleeve.

8. The apparatus of claim 6 wherein each said conduit section defines an annular recess for each fluid passage and said radial ports respectively communicate with said annular recesses; and seal rings disposed on both axial sides of said annular recesses to maintain said fluid passages isolated from each other.

9. The apparatus of claim 8 wherein said coupling sleeve defines an internal annular groove aligned with each said annular recess and communicating with only one of said radial port means in said coupling sleeve.

10. The apparatus of claim 6 further comprising means for respectively connecting a plurality of said fluid passages in said tubular conduit respectively to a plurality of selected zones of the subterranean bore.

11. Apparatus for conducting hydrological tests of selected earth formations adjacent a bore traversing said formations comprising a tubing string insertable in said bore; a pair of inflatable packers secured in said tubing string in axially spaced relation; said inflatable packers each having a fluid pressure inlet; a plurality of peripherally spaced, axially extending fluid passages formed in the wall of said tubing string; means for connecting one of said fluid passages to both of said fluid pressure inlets of said inflatable packers; means for supplying fluid pressure to said one fluid passage to concurrently inflate both said inflatable packers, thereby isolating a formation zone A between said inflated packers from formation zones B and C on each side of formation zone A; means for connecting a second, third and fourth one of said fluid passages to respectively monitor fluid pressure in formation zones A, B, and C; three fluid pressure responsive transducers mounted in the bore of said tubing string and respectively responsive to fluid pressure in said second, third and fourth fluid passages to generate electrical signals respectively proportional to fluid pressures in formation zones A, B and C; and cable means for transmitting said electrical signals to monitoring equipment at the bore entrance.

12. The apparatus of claim 11 further comprising a fluid fill-up valve mounted on the entering end of the first inflatable packer entering the bore; said fill-up valve having a chamber normally communicating between the earth bore and said one longitudinal passage; a piston type valve slidably and sealably mounted in said chamber and movable by fluid pressure supplied to said one fluid passage to close communication with the earth bore and permit inflation of both said inflatable packers.

13. The apparatus of claim 11 further comprising means for connecting a fifth one of said fluid passages to a source of purging gas; and port means connecting said fifth fluid passage to said formation zone A.

14. The apparatus of claim 11 further comprising means for connecting a fifth one of said fluid passages to a source of purging gas; and port means connecting said fifth fluid passage to both said inflatable packers to assist in deflation thereof.

* * * * *